US005285990A

United States Patent [19]

Engel

[11] Patent Number: 5,285,990

[45] Date of Patent: Feb. 15, 1994

[54] GOLF CLUB REST

[76] Inventor: Thomas H. Engel, 6455 S. Chestnut, Gilroy, Calif. 95020

[21] Appl. No.: 32,707

[22] Filed: Mar. 17, 1993

Related U.S. Application Data

[63] Continuation of Ser. No. 778,574, Oct. 17, 1991, abandoned, which is a continuation-in-part of Ser. No. 530,908, May 29, 1990, abandoned.

[51] Int. Cl.[5] ..... A47F 7/00

[52] U.S. Cl. ..... 248/156; 211/70.2; 248/545; 273/32 B

[58] Field of Search ..... 248/156, 530, 545, 96; 211/70.2; 373/32 E, 32 R, 32 B

[56] References Cited

U.S. PATENT DOCUMENTS

| | | | |
|---|---|---|---|
| D. 222,720 | 12/1971 | Lapham et al. | D34/5 |
| D. 232,449 | 8/1974 | Herring | D34/5 |
| D. 237,396 | 10/1975 | Herring | D34/5 |
| 699,391 | 5/1902 | Johnson | 248/96 X |
| 1,443,230 | 1/1923 | Luckett . | |
| 1,627,459 | 5/1927 | Ranney . | |
| 2,465,096 | 3/1949 | Hunt | 248/96 X |
| 2,564,318 | 8/1951 | Wick | 150/1.5 |
| 2,577,333 | 12/1951 | Klum et al. | 150/1.5 |
| 2,595,987 | 5/1952 | Shears | 150/1.5 |
| 2,716,432 | 8/1955 | Duffy | 248/96 X |
| 2,802,250 | 8/1957 | Klotz | 248/316.7 X |
| 2,858,868 | 11/1958 | Wallace | 150/1.5 |
| 2,887,137 | 5/1959 | Robb | 150/1.5 |
| 3,081,108 | 3/1963 | Vogt | 211/70.2 |
| 3,219,083 | 11/1965 | Asquith | 150/1.5 |
| 3,483,996 | 12/1969 | Scammon | 248/68.1 X |
| 3,503,518 | 3/1970 | Black | 211/70.2 |
| 3,954,239 | 5/1976 | Kerbs, Jr. | 248/96 |
| 4,449,310 | 5/1984 | Kline | 272/32 B X |
| 4,838,285 | 6/1989 | Petrone | 273/32 B |
| 4,838,416 | 6/1989 | Carman | 211/70.2 X |
| 4,852,896 | 8/1989 | Mills | 211/70.2 X |
| 5,080,239 | 1/1992 | Rowland | 273/32 E X |
| 5,127,530 | 7/1992 | Ortuno | 211/70.2 |
| 5,149,087 | 9/1992 | Thompson, Jr. | 248/96 X |

*Primary Examiner*—David A. Scherbel
*Assistant Examiner*—Derek J. Berger
*Attorney, Agent, or Firm*—Flehr, Hohbach, Test, Albritton & Herbert

[57] ABSTRACT

A portable golf club rest for temporarily supporting at least one golf club in a generally upright position is provided. The golf club rest, a freestanding, uncoupled club leaning support, is supported in a generally upright position by a ground penetrating segment when ground penetration is effected.

4 Claims, 3 Drawing Sheets

GOLF CLUB REST

CONTINUATION DATA

This is a continuation of application Ser. No. 07/778,574, filed Oct. 17, 1991, which is a continuation in part of application Ser. No. 07/530,908 filed on May 29, 1990, now abandoned.

BACKGROUND OF THE INVENTION

1. Field of the Invention

The present invention relates to the game of golf, and more particularly, but not by way of limitation, to a golf club rest which is designed to penetrate the ground and extend upwardly in an upright, freestanding position in order to provide temporary support for one or more golf clubs.

2. Description of Prior Art

A problem often encountered by golfers is having to place one or more of their golf clubs on the ground while hitting a shot. Such a situation frequently arises when a player's golf ball is lying in the area around the green, where a pitching wedge or similar type club is typically needed before using a putter. That is, a player may find it more convenient at times to carry only the few clubs needed to hit the next few shots, rather than carry his entire golf bag. In this situation, a player will typically place his putter on the ground before he hits the ball with his pitching wedge. After hitting the shot, the player will then retrieve the putter and place the pitching wedge on the ground.

The problem which arises is that the ground on which the clubs are laid is often wet from rain, watering or morning dew, thus resulting in wet and slippery grips which will hinder a player's next shot. In addition to causing the grips of the golf clubs to become slippery, a player will often forget to retrieve the club which remains on the ground after completing the hole since the club is not easily visible to the player when the club is placed on the ground. The result is lost golf clubs, or if a player is lucky, only the inconvenience of having to return to the hole to retrieve the club once the player discovers that the club is missing from his golf bag.

These same problems can also occur when a golfer is practicing rather than playing. For instance, when practicing at a driving range a golfer will often take only a few clubs with which to practice instead of taking his entire set of clubs. In a similar manner as described above, a golfer will place the clubs not being used on the ground while practicing with a selected club. As before, the golf clubs laying on the ground are subject to getting wet and being forgotten.

With these problems in mind, it is clear that a need has long existed for a golf club rest which will provide a temporary freestanding, uncoupled club leaning support for at least one golf club, thereby assuring a dry and clean grip for the next shot and keeping the golf clubs clearly visible to the player, while also being easily transported by attachment to the exterior of a golf club carrier or transported therein. It is to such a portable golf club rest that the present invention is directed.

Numerous prior art devices have been proposed for carrying and supporting golf clubs in an upright position. Typical of such a prior art device is the carrier and support for a golf club and accessories disclosed by Asquith (U.S. Pat. No. 3,219,083). Asquith teaches a device supported at two points having a spike for carrying golf clubs and supporting the clubs in a standing position.

Luckett (U.S. Pat. No. 1,443,230) discloses a device for carrying golf clubs which is provided with a stick for supporting the golf club carrier and the golf clubs inserted therein in an upright position.

Numerous other devices have been proposed by the prior art to carry golf clubs and to allow the golf clubs and carrier to be supported in a standing position. However, none of the prior art devices disclose a device which functions or operates to provide a freestanding club rest which is uncoupled to golf clubs in the manner of the present invention, or which obtains the ends and advantages of the present invention.

SUMMARY OF THE INVENTION

According to the present invention a portable golf club rest is provided for temporarily supporting at least one golf club in a generally upright position. Broadly, the golf club rest includes an elongated shaft member having a ground penetrating segment attached to a lower end portion for selectively penetrating the ground and for supporting the elongated shaft member in an upright and freestanding position relative to the ground when ground penetration is effected. A club rest member is supported by the upper end portion of the elongated shaft member to provide temporary partial support for a resting golf club. The golf club rest member cooperates with the ground to dispose the resting club in a generally upright position. Thus, the present invention provides a golf club rest that serves as a freestanding rest which is uncoupled with any clubs (that is, it is not coupled with the clubs to serve as a carrier of same), while at the same time being portable so as to be disposable in, or connected to, a golf bag for easy storage and transport.

An object of the present invention is to provide a golf club rest which will support at least one golf club in a generally upright freestanding position, thereby maintaining clean and dry golf club grips and keeping the golf clubs clearly visible to a golfer.

Another object of the present invention, while achieving the above-stated object, is to provide a golf club rest which is light weight and easily inserted into the ground.

Another object of the present invention, while achieving the above-stated objects, is to provide a golf club rest which is easily stored in a golf club carrier or easily attached to the exterior of a golf club carrier.

Yet another object of the present invention, while achieving the above-stated objects, is to provide a golf club rest which is economical to manufacture, durable in construction, and easy to use.

Other objects, advantages and features of the present invention will become apparent from the following detailed description when read in conjunction with the drawings and appended claims.

BRIEF DESCRIPTION OF THE DRAWINGS

FIG. 6 is a perspective view of a portion of a golf club rest of FIG. 5, more particularly illustrating the placement of a pair of golf clubs against the golf club rest.

DESCRIPTION

Figure 1:
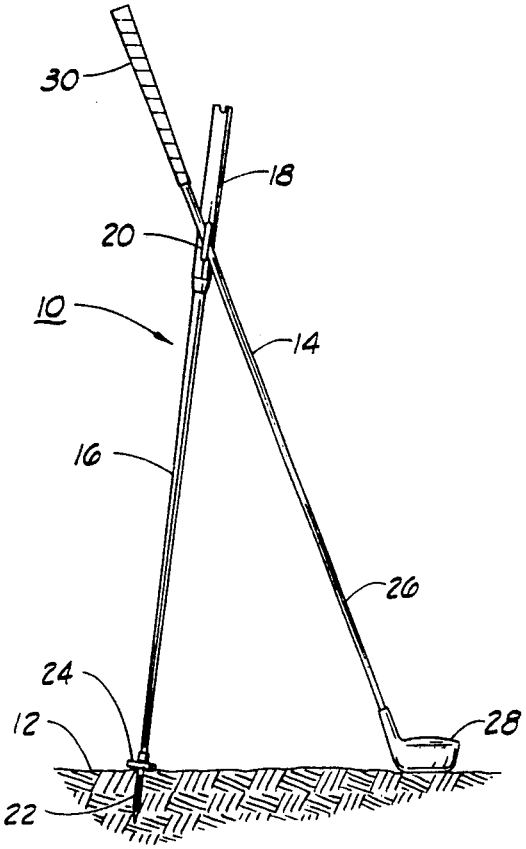
FIG. 1 is an elevational view of a golf club rest constructed in accordance with the present invention shown inserted into the ground and supporting a golf club in a generally upright position.
Figure 2:
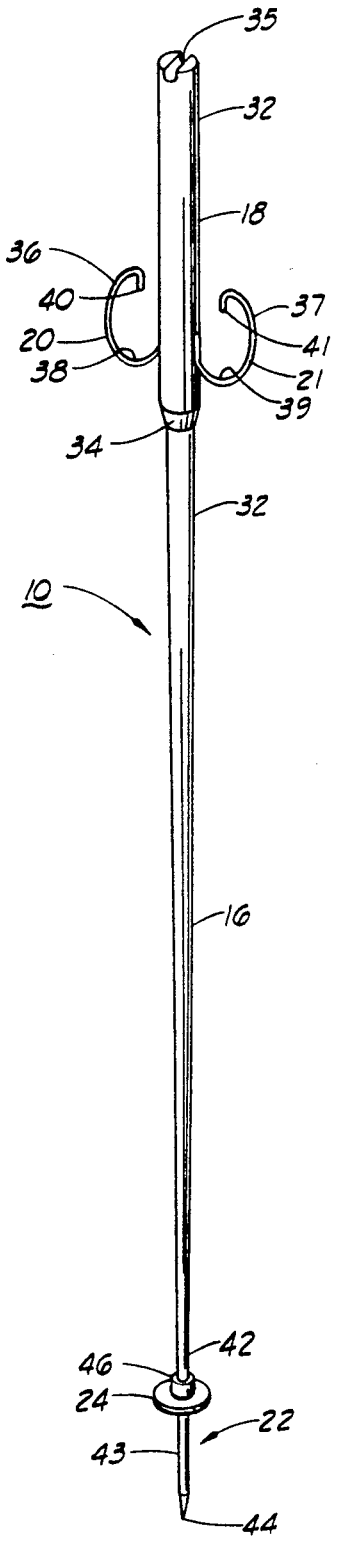
FIG. 2 is a perspective view of the golf club rest of FIG. 1.

Referring now to the drawings, and more specifically to FIGS. 1 and 2, a golf club rest 10 is shown inserted into a ground 12 and supporting a golf club 14. The golf club rest 10, has an elongated shaft member 16, a handle member 18, a pair of club rest members 20, 21 and a ground penetrating segment 22; and is supported in the ground 12 by the insertion of the ground penetrating segment 22 of the golf club rest 10 into the ground 12 such that a disc element or guard member 24 of the ground penetrating segment 22 is substantially flush with the surface of the ground 12. The penetration of the ground penetrating segment 22 stabilizes the golf club rest 10 in an upwardly, freestanding position, thus enabling the golf club 14 to be supported when disposed against the club rest member 20 of the golf club rest 10. More specifically, a shaft 26 of the golf club 14 is disposed against the club rest member 20 such that a head 28 of the golf club 14 rests on the ground 12 and a grip portion 30 of the golf club 14 projects upward from the club rest member 20, as shown in FIG. 1.

Referring now to FIG. 2, the handle member 18 of the golf club rest 10 is fitted to an upper end portion 32 of the elongated shaft member 16. The handle member 18 is larger in diameter than the elongated shaft member 16 and is provided with a handle taper 34, located at the bottom end of the handle member 18. A cigarette/cigar slot 35 is provided in the top end of the handle member 18 for holding a cigarette or cigar while a golfer is in the act of hitting a shot.

Club rest members 20, 21, are provided with arcuately shaped end portions 36, 37 which form club resting cradles 38, 39 and temporarily support the resting golf club 14 in a generally upright position in cooperation with the ground 12 (FIG. 1). The club rest members 20, 21 are attached to the handle member 18 in an oppositely-disposed relationship in some suitable manner, such as welding. The unattached, arcuately shaped end portions 36, 37 are provided with downwardly extending nib portions 40, 41, the purpose of which will be described in further detail below.

The ground penetrating segment 22 is attached to a lower end portion 42 of the elongated shaft member 16, and is provided with a rod member 43 having a spear point 44 defined on one end to facilitate insertion of the golf club rest 10 into the ground 12 (FIG. 1). The disc element 24 of the ground penetrating segment 22 projects transversely from an upper portion of the rod member 43 and is provided to limit the depth of penetration of the ground penetrating segment 22 into the ground 12 and to stabilize the elongated shaft member 16 in its upright position relative to the ground 12 (FIG. 1). The upper portion of the ground penetrating segment 22 is formed with a collar 46 which is adapted to receive the lower end portion 42 of the elongated shaft member 16. The elongated shaft member 16 is secured in the collar 46 of the ground penetrating segment 22 in a conventional fashion, typically a weld.

Figure 3:
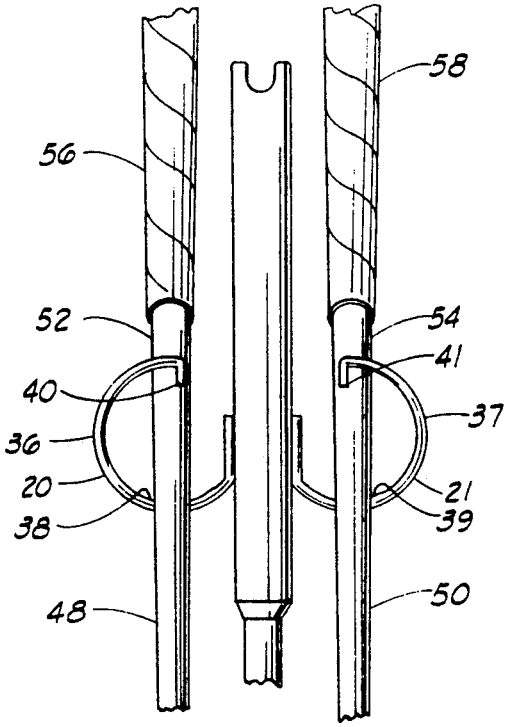
FIG. 3 is a perspective view of a portion of the golf club rest of FIGS. 1 and 2, more particularly illustrating the placement of a pair of golf clubs against the golf club rest.

In FIG. 3, the positioning of shafts 48, 50 of golf clubs 52, 54 into the club rest members 20, 21 is illustrated. As shown, the shafts 48, 50 of the golf clubs 52, 54 are disposed uncoupled against the club resting cradles 38, 39 of the club rest members 20, 21. Sufficient space is provided between each nib portion 40, 41 and the elongated shaft 16 so that the shafts 48, 50 of the golf clubs 52, 54 may be easily leaned against the club resting cradles 38, 39 of the club rest members 20, 21 and easily removed therefrom as well. The nib portions 40, 41 of the club rest members 20, 21 serve to secure each shaft 48, 50 within the club rest members 20, 21 to avoid displacement of the golf clubs 52, 54 from the golf club rest 10 by a force such as the wind and to insure that the golf clubs 52, 54 remain in a generally upright position with the grip portions 56, 58 extending in an upwardly direction from the club rest members 20, 21 so as to remain elevated from the ground 12 (FIG. 1).

Figure 4:
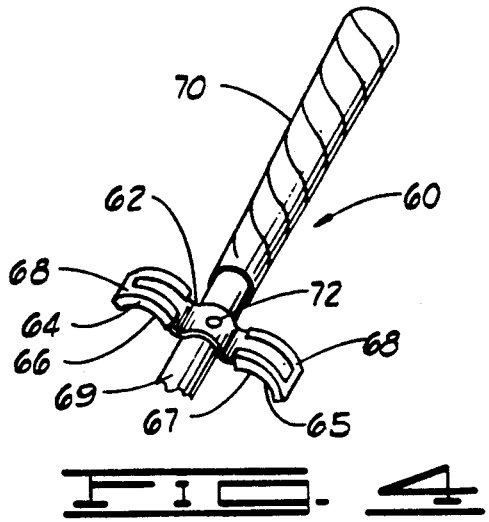
FIG. 4 is a perspective view of a portion of another embodiment of a golf club rest of the present invention.

FIG. 4 shows the upper portion only of another golf club rest 60. The golf club rest 60 is similar to the golf club rest 10, but rather than using a pair of club rest members 20, 21, a single club rest member 62 is used to support golf clubs in a manner similar to that described above. The club rest member 62 is shaped to have arcuately shaped end portions 64, 65, which in turn form club resting cradles 66, 67. Each club resting cradle 66, 67 is provided with a rubber or plastic sleeve 68 to prevent golf clubs from slipping when such are disposed to lean against the club resting cradles 66, 67. The club rest member 62 is attached to an elongated shaft member 69 of the golf club rest 60 below a handle 70 by a rivet 72, as shown.

Referring now to FIG. 5-8, a golf club rest 80 is illustrated. The golf club rest 80, similar to that discussed above, has an elongated shaft member 82, a handle member 84, a ground penetrating segment 86, a club rest member 88 and a support clip 90. The handle member 84 is securely attached about an upper end portion 92 of the elongated shaft member 82 in a conventional manner, typically with some type of adhesive, such that the handle member 84 is axially aligned with the elongated shaft member 82.

The ground penetrating segment 86, is connected to a lower end portion 100 of the elongated shaft member 82, and includes a rod member 94, a disc or guard member 96, and a collar 98. The rod member 94 is characterized as having a spear point 102 defined on the end thereof to facilitate penetration of the rod member 94 into the ground 12 (FIG. 1). The disc member 96 projects transversely from the upper portion of the rod member 94 and is provided in order to limit the depth of penetration of the ground penetrating segment 86 into the ground 12 (FIG. 1) and to stabilize the elongated shaft member 82 in its upright, free-standing position relative to the ground 12. Located at the upper portion of the ground penetrating segment 86 is the collar 98 which is adapted to receive the lower end portion 100 of the elongated shaft member 82 so that the ground penetrating segment 86 can be securely attached to the elongated shaft member 82. The elongated shaft member 82 is secured in the collar 98 in a suitable fashion, typically a weld.

The club rest member 88 is provided with arcuately shaped end portions 104, 105, which form club resting cradles 106, 107 and temporarily support a resting golf club in a generally upright position in cooperation with the ground, and a curved medial portion 108. The curved medial portion 108 is arcuately shaped to fit around a portion of the elongated shaft member 82 so that the elongated shaft member 82 supports the club rest member 88 when shafts 110 and 112 of golf clubs 114 and 116, respectively, disposed uncoupled against the club resting cradles 106, 107 (as illustrated in FIG. 6). The club rest member 88 is secured to the elongated shaft member 82 at the medial portion 108 of the club rest member 88 with a rivet 118, as shown.

The club resting cradles 106, 107 of the club rest member 88 are each provided with a rubber sleeve member 120 and 122, respectively, in order to frictionally support the shafts 110 and 112 of the golf clubs 114 and 116 and also to prevent damage to the shafts 110 and 112 when such are disposed to lean against the club resting cradles 106, 107.

The golf club rest 80 can be constructed of substantially any desired material, including metal, fiber glass, plastic or the like. Nevertheless, a preferred material for the construction of the elongated shaft member 82 is steel, with the elongated shaft member 82 in turn, being chrome plated; whereas the ground penetrating segment 86 is preferably constructed of aluminum and the handle member 84 of rubber.

Figure 7:
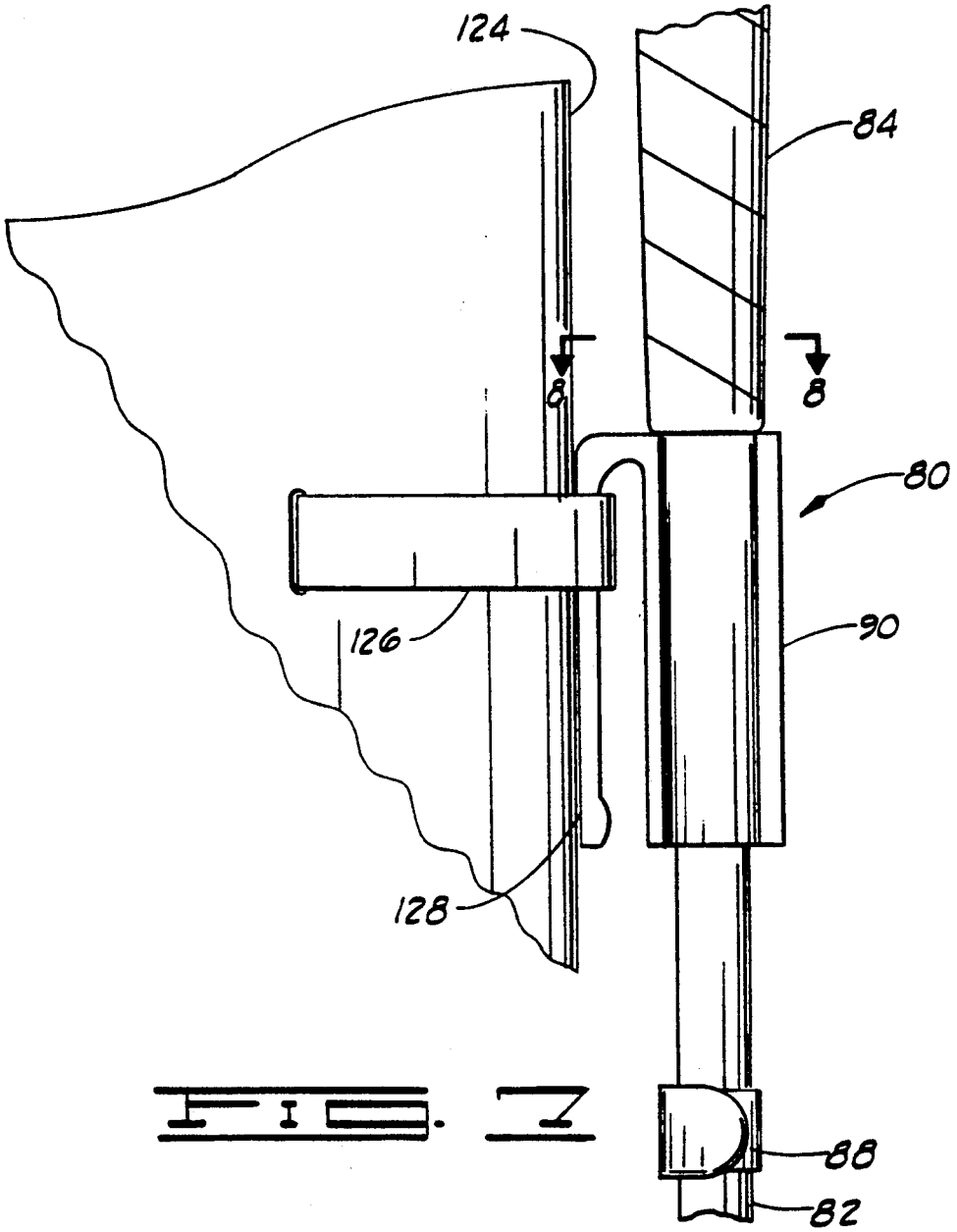
FIG. 7 is a side elevational view of a portion of the golf club rest of FIG. 5, illustrating the golf club rest attached to a strap of a golf club carrier.
Figure 8:
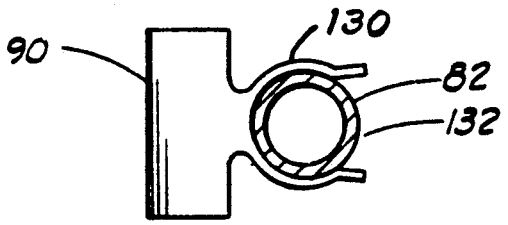
FIG. 8 is a horizontal cross-sectional view taken along the line 8—8 of FIG. 7.

The preferred materials used for construction of the golf club rest 80 provide a device which is durable and light-weight. As a result, the golf club rest 80 can be easily stored and transported in a golf club carrier 124, or in the alternative, the support clip 90 can be utilized to support the golf club rest 80 on a portion of the golf club carrier 124, such as a strap 126 provided on the exterior of the golf club carrier 124, (FIG. 7).

The support clip 90 is provided with a hook-shaped portion 128. The hook-shaped portion 128 is outwardly flexible, thereby allowing the hook-shaped portion 128 to slidably clip over a portion of the golf club carrier 124, such as the strap 126. The flexibility of the hook-shaped portion 128 allows the hook-shaped portion 128 to clip over the strap 126 after the support clip 90 is slid over the strap 126, thus retaining the support clip 90 around the strap 126 as desired. When detaching the support clip 90 from the strap 126, and therefore the golf club rest 80, the hook-shaped portion 128 is slid back over the strap 126 in the reverse manner as when the hook-shaped portion 128 was attached to the strap 126.

Figure 5:
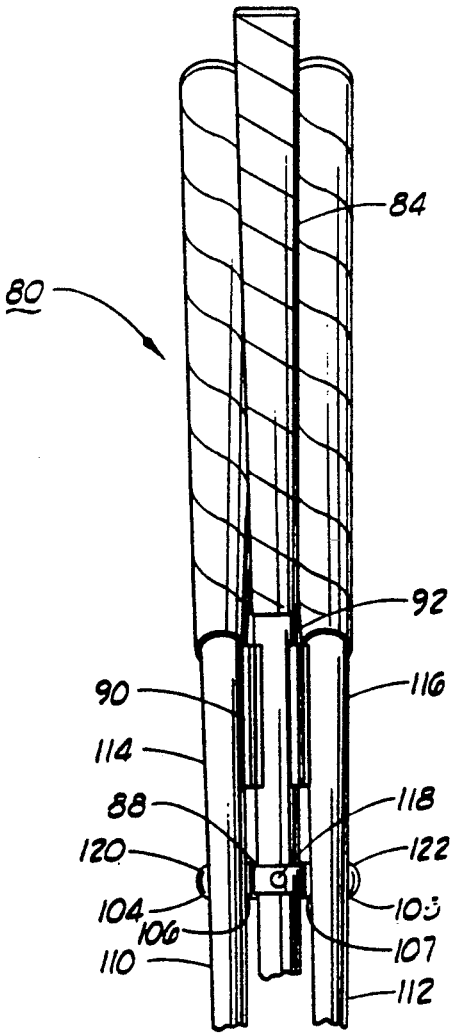
FIG. 5 is a perspective view of yet another embodiment of a golf club rest of the present invention.
Figure 5:
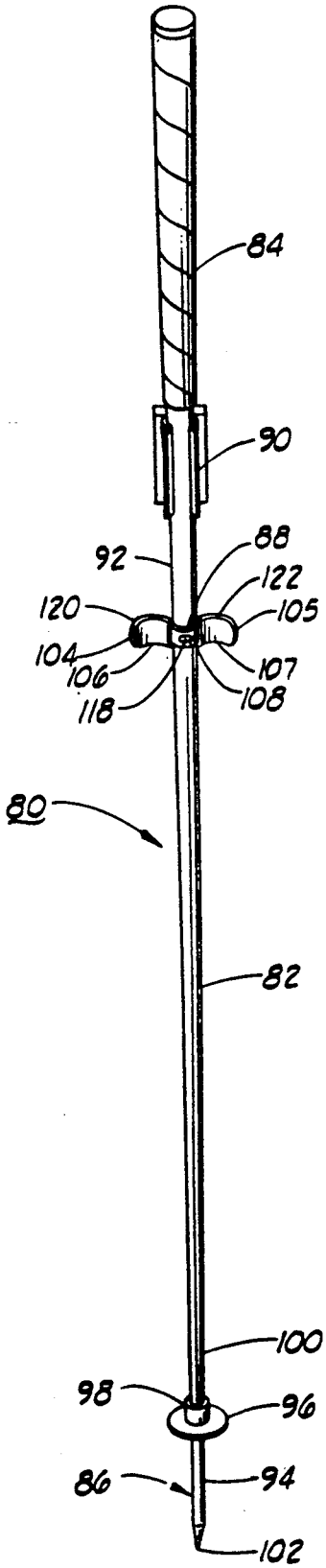

The support clip 90 also includes a tongs portion 130 for removably attaching the support clip 90 to the elongated shaft member 82 of the golf club rest 80. As more clearly shown in FIG. 8, the tongs portion 130 is adapted to extend substantially around the elongated shaft member 82 of the golf club rest 80, thereby holding the support clip 90 on the elongated shaft member 82. It should be noted that the support clip 90 slides along the elongated shaft member 82 when the support clip 90 is attached thereon as a result of the elongated shaft member 82 having a smaller diameter than the tongs portion 130. As such, the support clip 90 is preferably attached to the upper end portion 92 of the elongated shaft member 82 between the handle member 84 and the club rest member 88 (as shown in FIGS. 5 and 6), so that the support clip 90 supportingly engages the bottom of the handle member 84 when the golf club rest 80 is attached to the golf club carrier 124.

The support clip 90 is constructed of a pliable material, such as plastic, in order to enable the hook-shaped portion 128 to outwardly flex when attaching the support clip 90 to the golf club carrier 124 and when detaching the support clip 90 therefrom. The pliable material used for construction of the support clip 90 further enables the hook-shaped portion 128 to return to its original position, thus retaining the support clip 90 on the golf club carrier 124. The tongs portion 130 requires flexibility as well. The support clip 90 is attached about the elongated shaft member 82 of the golf club rest 80 by inserting the elongated shaft member 82 through an opening 132 located around the circumference of the tongs portion 130; and because the opening 132 is smaller in diameter than the upper end portion 92 of the elongated shaft member 82, the tongs portion 130 must be capable of flexing outwardly when attaching and detaching the support clip 90, and capable of returning to its original form to clip around the elongated shaft member 82.

It is clear that the present invention is well adapted to carry out the objects and to obtain the ends and advantages mentioned herein as well as those inherent in the invention. While presently preferred embodiments of the invention have been described for purposes of this disclosure, numerous changes may be made which will readily suggest themselves to those skilled in the art and which are accomplished within the spirit of the invention disclosed and defined in the appended claims.

What is claimed is:

1. A portable golf club rest detachably connectable to a golf club carrier for temporarily supporting at least one golf club in a generally upright position removed from the golf club carrier, the golf club rest comprising:

shaft means for providing a temporary freestanding uncoupled club leaning support, the shaft means comprising an elongated shaft member having an upper end portion and a lower end portion;

a handle member attached to the upper end portion of the elongated shaft such that the handle member is axially aligned with the elongated shaft member;

ground penetrating means attached to the lower end portion of the elongated shaft member for selectively penetrating the ground and for supporting the elongated shaft member substantially upright from the ground when ground penetration is effected;

club support means supported by the upper end portion of the elongated shaft member adjacent the handle member for providing temporary partial support of a resting golf club, the golf club rest shaft means cooperating with the ground so that the club support holds the resting club in a generally upright position;

a support clip portion adapted to slidably clip over a portion of the golf club carrier, and a tong portion adapted to extend substantially around the elongated shaft member so that the club rest is removably attached to the golf club carrier.

2. The golf club rest of claim 1 wherein the ground penetrating means comprises a rod member having a spear point defined on one end and a disc member projecting transversely from an upper portion of the rod member to limit the depth of penetration of the rod member into the ground and to stabilize the elongated shaft member in an upright position relative to the ground.

3. The golf club rest of claim 1 wherein the club support means comprises:

a club rest member having at least one arcuately shaped end portion forming a club resting cradle, and wherein the club resting cradle is provided with a sleeve to frictionally support the golf club and to prevent damage to the golf club when such is disposed to lean against the club resting cradle.

4. The golf club rest of claim 3 wherein the handle member is provided with a cigarette/cigar slot on the end thereof.

* * * * *